US006567639B1

(12) United States Patent
Murata et al.

(10) Patent No.: US 6,567,639 B1
(45) Date of Patent: May 20, 2003

(54) FIXING DEVICE FOR HEAT PRESSURE FIXING A RECORD MEDIUM AND METHOD THEREOF

(75) Inventors: Hiroshi Murata; Masashi Hiroki; Takao Izumi, all of Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/717,230

(22) Filed: Nov. 22, 2000

(51) Int. Cl.[7] ..... G03G 15/20
(52) U.S. Cl. ..... 399/329; 219/216; 432/60
(58) Field of Search ..... 399/69, 70, 328–330; 347/156; 432/60; 219/216, 469

(56) References Cited

U.S. PATENT DOCUMENTS 5,164,782 A * 11/1992 Nagayama et al. ..... 399/328 X
5,499,089 A * 3/1996 Tsukamoto et al. ..... 219/216 X
5,543,905 A * 8/1996 Oda et al. ..... 219/216 X
5,714,736 A * 2/1998 Yoneda et al. ..... 219/216
5,794,105 A * 8/1998 Tamaoki et al. ..... 399/329 X

* cited by examiner

*Primary Examiner*—William J. Royer
(74) *Attorney, Agent, or Firm*—Foley & Lardner

(57) ABSTRACT

A fixing device according to the present invention includes a fixing belt and heats up a record medium having a developed image, a pressure roller pinches and conveys the record medium together with the fixing belt and fixes the developed image, a heating roller contacts the fixing belt and heats up the fixing belt at a specified temperature, and a heater that is arranged in the heating roller and displaced toward the radius direction of the contact side with the fixing belt from the rotational center of the heating roller and heats up the heating roller. Further, in the heating roller, the heater is arranged so as to be displaced toward the radius direction at the upstream side of the transfer direction of the fixing belt from the central position of the contact area of the fixing belt and the heating roller.

13 Claims, 5 Drawing Sheets

FIXING DEVICE FOR HEAT PRESSURE FIXING A RECORD MEDIUM AND METHOD THEREOF

BACKGROUND OF THE INVENTION

1. Field of the Invention

The present invention relates to a fixing device that heat pressure fixes a developed image on a record medium by use of a heated endless fixing belt, and a method thereof.

2. Description of the Related Art

In the prior art, as a fixing device which heat pressure fixes a toner image formed on a paper sheet and that is employed in image forming devices such as electronic photo type copiers, printers, and so forth, developed is a belt type fixing device wherein a toner image is heat pressure fixed by the steps of heating an endless fixing belt, and inserting a paper sheet into a nip portion between the fixing belt and a pressure roller that presses onto and contacts the fixing belt.

Conventionally, in this belt type fixing device of the prior art, as shown in FIG. 1, at the rotational center thereof, a fixing belt 4 is set between a heating roller 2, in which a heater 1 of electricity consumption of for example 600 W/h is built, and a supporting roller 3, and thereby the fixing belt 4 is heated by contact with the heating roller, while a pressure roller 6 is press contacted to a position facing toward the supporting roller 3 via the fixing belt 4, and a paper sheet 7 is made to go through a nip portion that is formed between the fixing belt 4, heated at a fixing available temperature by the heating roller 2, and the pressure roller 6, thereby the toner image is heat pressure fixed.

On the other hand, in electric photo type image forming devices in recent years, there is a demand for high speed image formation and a demand for reducing electricity consumption. Among components, especially a fixing device requires a heat generation source at high temperatures, and the electricity consumption of a fixing device occupies around 60% to 70% of the whole electricity that an image forming device consumes. Consequently, it is required to reduce electricity consumption of a fixing device to be employed in an image forming device without deteriorating high speed processing of the image forming device.

As a means to realize power saving by a fixing device, it is effective to reduce electricity consumption of a heat generation source by the fixing process. Besides this, saving power used by a fixing device is realized by shortening warm up time from the moment when an image forming device mainframe is turned on to the moment when the temperature of a fixing belt reaches a specified temperature, or shortening a first copy time from the moment when a next fixing process is in standby status after completion of a fixing process to the moment when the temperature of a fixing belt reaches a temperature for fixation availability.

However, in order to effectively save power in a belt type fixing device, and reduce electricity consumption of a heater as a heat generation source, and increase the temperature of a fixing belt to a temperature for fixation availability without deteriorating the high speed of image formation, it is required to increase a contact area where a fixing belt contacts a heating roller, and to sufficiently secure contact time of the fixing belt and heating roller.

One problem that remains, however, is that making the diameter of a heating roller greater, as a measure to sufficiently secure contact time between a fixing belt and a heating roller, leads to a larger size fixing device, that goes against aimed compact size and light weight of the fixing device. And further, a heating roller with a large diameter requires a large heat capacity to heat up the heating roller itself, as a result, warm up time and first copy time are made longer.

As a corollary, in belt type fixing devices, it is desired to effectively reduce electricity consumption, without deteriorating the compact size and light weight of the image forming devices, and without deteriorating the high speed processing of the image forming devices including shortened warming up time and first copy time.

SUMMARY OF THE INVENTION

Accordingly, an object of the present invention is to reduce electricity consumption in fixing process by a fixing belt without loss in a high speed of fixing time for a high speed image forming device.

Another object of the present invention is to reduce electricity consumption without making larger the size of a fixing device and an image forming device to which the fixing device is assembled.

Still another object of the present invention is to shorten warm up time and first copy time, thereby making fixing time faster, and reducing electricity consumption at warm up time and first copy time.

According to the present invention, provided is a fixing device comprising: first heating means, in the form of an endless belt, for heating a record medium having a developed image; pressurizing means, in the form of a roller, for pinching and conveying the record medium together with the first heating means to fix the developed image; second heating means, in the form of a roller contacting the first heating means for heating the first heating means at a specified temperature; and third heating means that is arranged in the second heating means and displaced from the rotational center of the second heating means to the first heating means side for heating the second heating means.

Further, according to the present invention, provided is a fixing device comprising: a fixing belt , in the form of an endless belt to heat a record medium having a developed image; a pressure roller, in the form of a roller to pinch and convey the record medium together with the fixing belt to fix the developed image; a heating roller, in the form of a roller contacting the fixing belt to heat the fixing belt at a specified temperature; and a heater that is arranged in the heating roller and displaced from the rotational center of the heating roller to the fixing belt side to heat the heating roller.

Still further, according to the present invention, provided is a fixing method wherein a record medium having a developed image is pinched and conveyed by a fixing belt which is heated by contact with a heating roller and a pressure roller, and thereby the developed image is heat pressure fixed, comprising the steps of: heating the heating roller by a heater that is arranged in the heating roller and displaced from the rotational center of the heating roller to the radius direction of the fixing belt side, and further displaced from the central position of contact area of the heating roller to the upstream side in the conveyance direction of the fixing belt; making the heating roller contact the fixing belt thereby heating up the fixing belt; and inserting the record medium into a nip portion that is formed between the fixing belt after going away from the heating roller, and a pressure roller that pressure contacts the fixing belt.

DESCRIPTION OF THE PREFERRED EMBODIMENTS

The invention is illustrated in more detail by reference to the following referential examples and preferred embodiments.

Figure 2:
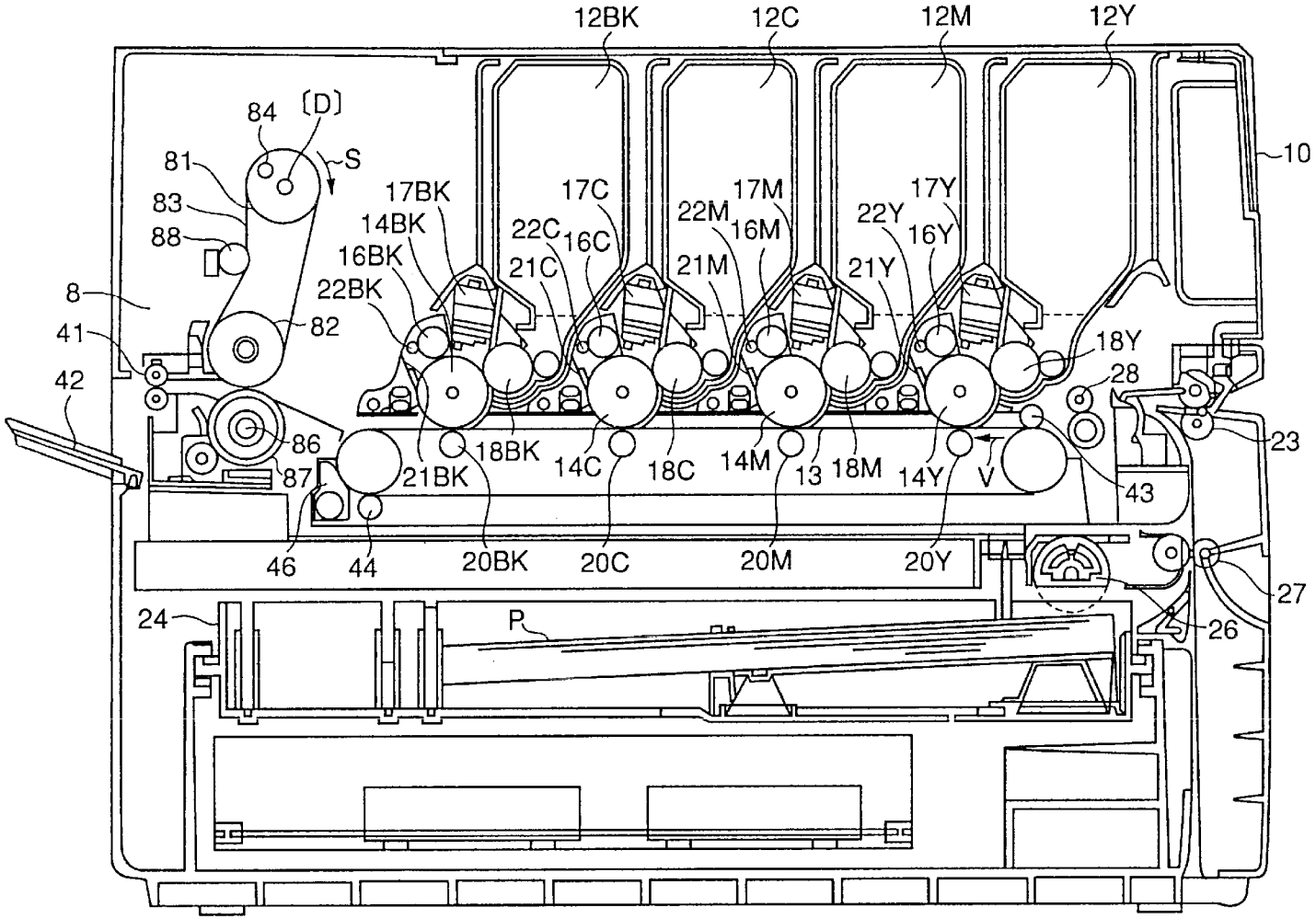
FIG. 2 is a structural figure schematically showing an image forming portion of a full color printer to which a fixing device according to a preferred embodiment of the present invention is loaded.

FIG. 2 is a structural drawing schematically showing an image forming portion 10 of a full color printer as a full color electronic photographic device to which a belt type fixing device 8 as a preferred embodiment of the present invention is loaded. Inside of the image forming portion 10, arranged in parallel along a transfer conveyor belt 13 as a paper sheet conveyer portion are 4 sets of recording devices 12Y, 12M, 12C and 12BK that form an image in each color element respectively by use of toners of yellow (Y), magenta (M), cyan (C), and black (BK).

Each of the respective recording devices 12Y, 12M, 12C and 12BK has a same structure, therefore descriptions are made with reference with the recording device 12Y for yellow (Y) that is arranged at the front stage, while as for other recording devices 12M, 12C and 12BK, identical codes and suffixes representing respective colors are applied to identical parts, and descriptions thereof are omitted herein.

The recording device 12Y has a photosensitive drum 14Y, and arranged around the photosensitive drum in the rotational direction thereof are an electrostatic charger 16Y, an exposure device 17Y that radiates a light signal of yellow (Y), a developing device 18Y, a transfer roller 20Y, a cleaning device 21Y, an electrostatic discharger 22Y in this sequential order. The transfer roller 20Y is arranged so to face the photosensitive drum 14Y via the transfer conveyor belt 13.

Further arranged under the respective recording devices 12Y, 12M, 12C and 12BK are a paper sheet feed cassette device 24 that contains paper sheet P as a record medium, a pickup roller 26 that takes paper sheet P from the paper sheet feed cassette device 24, a transfer roller 27 that conveys paper sheet P taken out from the paper sheet feed cassette device 24, and a resist roller 28 that supplies paper sheet P to the transfer conveyor belt 13 at certain timing intervals. The conveyance speed of paper sheet P by the resist roller 28 and the transfer conveyor belt 13 is set so as to become the same as the circumferential speed of the photosensitive drums 14Y, 14M, 14C and 14BK. The code 23 represents a hand insertion paper sheet feed roller that allows paper sheets P to be fed in a manual manner.

Still further arranged at the downstream side of the transfer conveyor belt 13 are a belt type fixing device 8, paper discharge roller coupling 41, and a paper discharge tray 42. In addition, the code 43 is an absorption roller that gives electric charge so as to make paper sheet P absorb onto the transfer conveyor belt 13, and the code 44 represents a transfer conveyor belt electrostatic discharger, while the code 46 represents a transfer conveyor belt cleaner.

Now the belt type fixing device 8 is explained in more details hereinafter. Between a heating roller 81 consisting of an aluminum (Al) cylinder whose metal core thickness is 3 mm as a second heating means, and a support roller 82 as a supporting means consisting of a stainless steel metal core covered with 6 mm thick silicon rubber, arranged is a 0.3 mm thick endless fixing belt 83 as a first heating means consisting of a polyamide base covered with silicon rubber. The fixing belt 83 is rotated and conveyed at a transfer speed of 170 mm/s in the arrow S direction.

In the hollow inside of the heating roller 81, arranged is a first heater lamp 84 having an electricity consumption 600 W/h as a third heating means. The first heater lamp 84 arranged inside of the heating roller 81 is arranged displaced toward the upstream side of the conveyance direction of the fixing belt 83 from the central position [B] of the contact area from the contact start position [A] where the fixing belt 83 and the heating roller 81 start contacting with each other, to the separation position [C] where the fixing belt 83 separates from the heating roller 81. Namely, the first heater lamp 84 is arranged displaced toward the radius direction from the rotational center [D] of the heating roller 81, at the upstream side of the conveyance direction of the fixing belt 83 from the central position [B].

In the case where the first heater lamp 84 is arranged displaced toward the downstream side of the conveyance direction of the fixing belt 83 from the central position [B], timing of rapid temperature increase of the fixing belt 83 is delayed. Accordingly, the fixing belt 83 may not have sufficient contact time with the heating roller 81, and may not reach heating temperatures required, so taking this into account, it is preferable that the first heater lamp 84 is displaced toward the upstream side of the conveyance direction of the fixing belt 83 from the central position [B], in the heating roller 81.

Figure 6:
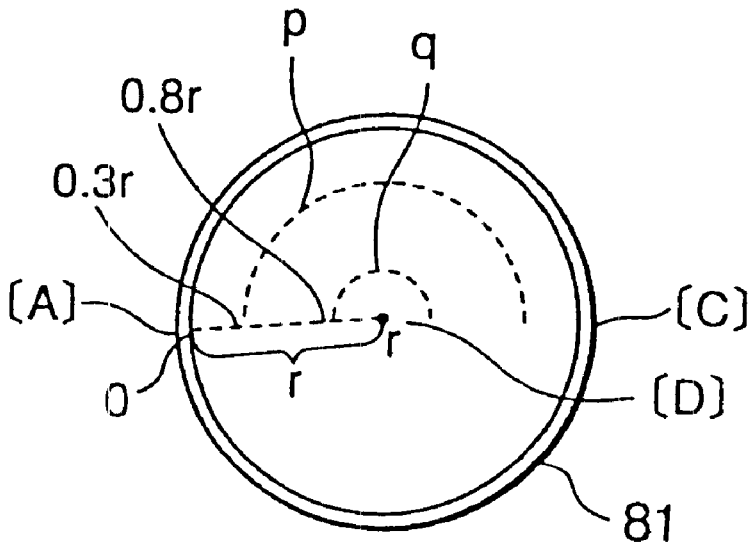
FIG. 6 is an explanatory diagram schematically showing a preferred arrangement range for a heater in the radius direction in a heating roller according to a preferred embodiment of the present invention.

Further, as for the displacement range of the first heater lamp 84 in the radius direction from the rotational center [D] in the heating roller 81, in the case where the inside radius of the heating roller 81 is designated as r, the inside wall position of the heating roller 81 is designated as o, and the rotational center [D] position of the heating roller 81 is designated as r, preferable is the range from the position of 0.3 r from the inside wall of the heating roller 81 shown in dot line p in FIG. 6, to the position of 0.8 r from the inside wall of the heating roller 81 shown in dot line q in FIG. 6.

In the case where the displacement range of the heating roller 81 of the first heater lamp 84 from the rotational center thereof [D] in the heating roller 81 is nearer to the rotational center than 0.8 r from the inside wall of the heating roller 81, the effect of displacement of the first heater lamp 84 from the rotational center [D] does not appear conspicuously, and there is a fear that the fixing belt 83 may not reach fixation available temperatures.

On the other hand, in the case where the displacement range of the heating roller 81 of the first heater lamp 84 from the rotational center thereof [D] in the heating roller 81 is displaced toward the inside wall direction more than 0.3 r from the inside wall of the heating roller 81, the ON/OFF actions of the first heater lamp 84 that are carried out so as to control the temperature of the fixing belt 83 causes uneven temperatures on the fixing belt 83. If an image fixing operation is conducted by use of the fixing belt 83 having uneven temperatures, there may be uneven luster in an image, especially uneven luster in the case of fixing a contact print image may become conspicuous, deteriorating image quality.

While, at the position facing to the support roller 82 of the fixing belt 83 arranged between the heating roller 81 and the support roller 82, pressure contacted is a pressure roller that is a pressurizing means and consists of a stainless steel metal core covered with 1.5 mm thick silicon rubber, and a second heater lamp 86 at the rotational center of the hollow inside thereof. By the way, to the external surface of the fixing belt 83, touches an oil application roller 88 that applies silicone oil to the fixing belt 83.

In the fixing device 8 structured as mentioned heretofore, a paper sheet P that has a toner image is inserted into a nip portion that is formed by the fixing belt 83 heated at fixation available temperatures and the pressure roller 87 that pressure contacts the fixing belt 83, thereby a toner image is heat pressure fixed. By the way, the first heater lamp 84 and the second heater lamp 86 are respectively controlled ON/OFF, thereby the surface temperature of the fixing belt 83 and the pressure roller 87 is controlled at a specified temperature.

Figure 1:
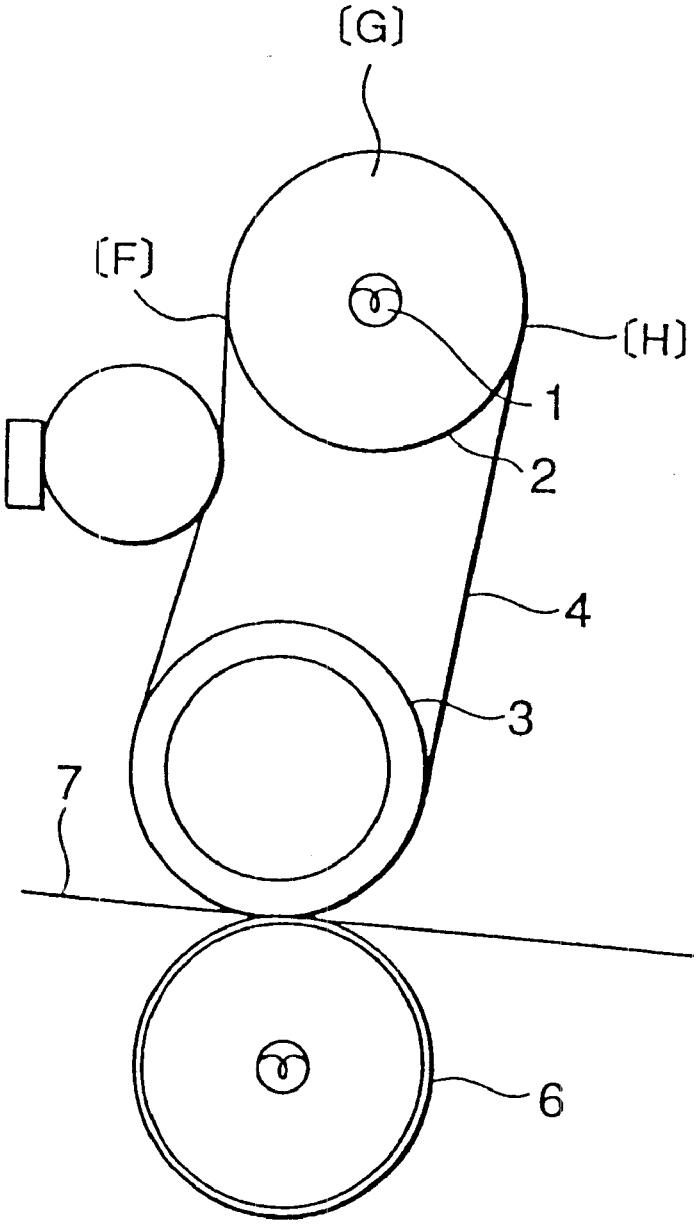
FIG.1 (PRIOR ART)
FIG. 1 is an explanatory diagram schematically showing a conventional fixing device according to the prior art.

In the next place, described in detail are the temperature increase characteristics of the fixing belt 83 that is heated up by the heating roller 81. Firstly, in a conventional heating roller 2 in the prior art as shown in FIG. 1, a heater 1 is arranged at the rotational center, and the heat amount given by the heater is uniform all around the heating roller, as a consequence, the fixing belt 4 is heated up almost evenly as shown in FIG. 4, while it goes from the contact start position [F] to the heating roller 2, and through the central position [G] of the contact area with the heating roller 2, and it reaches the separation position [H] where it separates from the heating roller 2, and the temperature thereof is increased linearly.

For this reason, if the transfer speed of the fixing belt 4 is increased so as to cope with a high speed machine type, the heating time of the fixing belt 4 by the heating roller 2 is shortened, as a result, it becomes impossible for the fixing belt 4 to attain a sufficient temperature increase. Concretely, for instance, in the case where the transfer speed of the fixing belt 4 is 100 mm/s during a fixing operation, the temperature of the fixing belt 4 goes up to over 160° C., at the separation position [H] where the fixing belt 4 goes away from the heating roller 2, as shown in solid line j in FIG. 4, and it is possible to attain fixation available temperatures.

Figure 4:
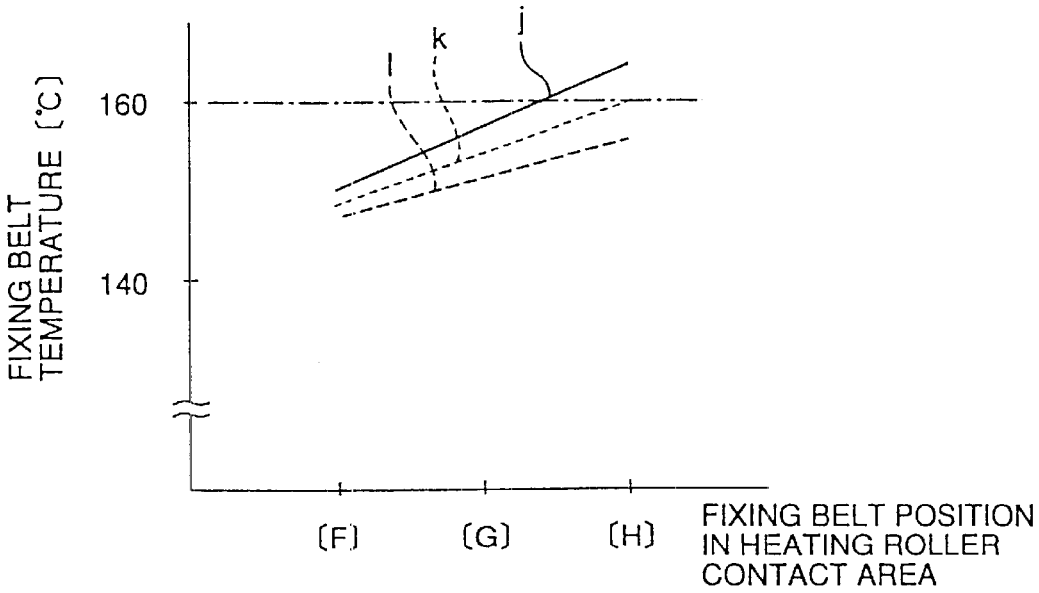
FIG.4 (PRIOR ART)
FIG. 4 is a graph showing temperatures of a fixing device at positions [F], [G], and [H] around a heating roller of the conventional fixing device shown in FIG. 1.

However, when the transfer speed of the fixing belt 4 is made further higher, even if it reaches the separation position [H] from the heating roller 2, the fixing belt 4 cannot attain a sufficient temperature increase, for instance, in the case where the transfer speed is 170 mm/s, even though the heating temperature of the fixing belt 4 reaches 160° C. at best as shown in dot line k in FIG. 4, when the transfer speed of the fixing belt 4 is further made 240 mm/s, the heating temperature of the fixing belt 4 cannot reach 160° C. as shown in broken line 1 in FIG. 4, causing fixation failure of paper sheet P.

Figure 3:
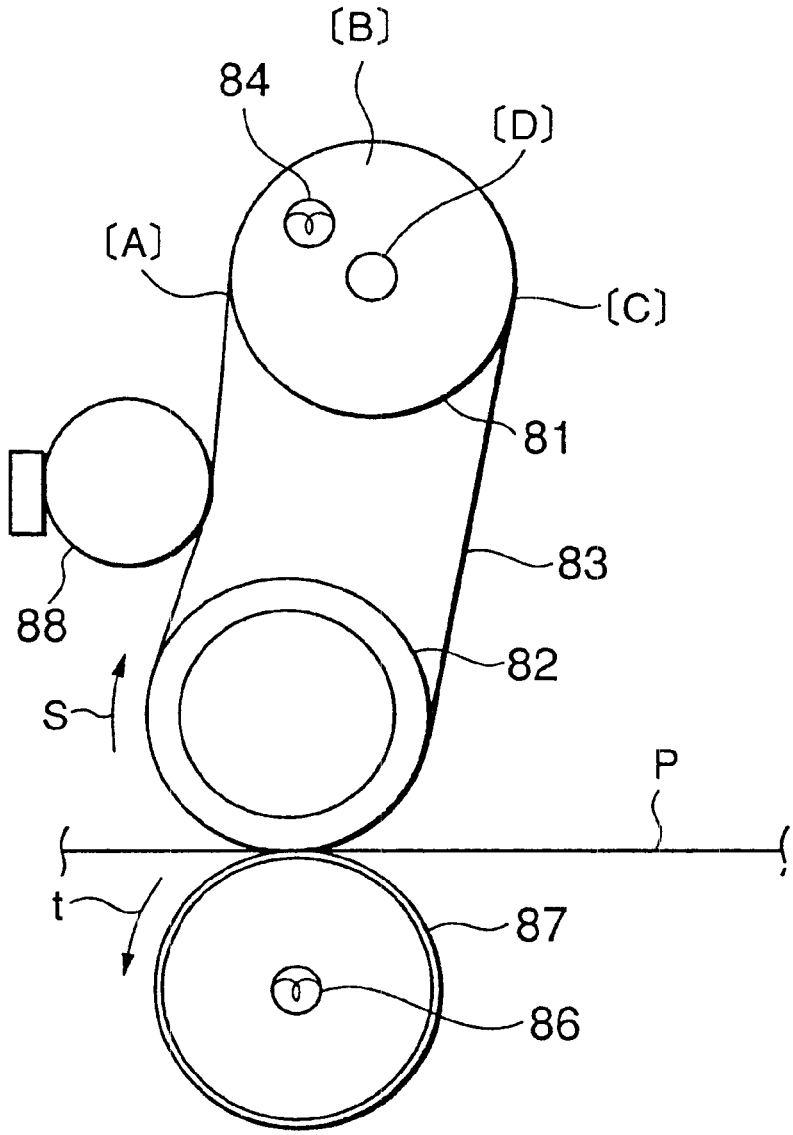
FIG. 3 is an explanatory diagram schematically showing a fixing device according to a preferred embodiment of the present invention.

In the meantime, in the fixing device 8 as one preferred embodiment according to the present invention, inside of the heating roller 81, the first heater lamp 84 is arranged at the upstream side of the transfer direction of the fixing belt 83 from the central position [B] between the contact start position [A] and the separation position [C] in FIG. 3, and is displaced toward the radius direction from the rotational center [D] of the heating roller 81. As a consequence, though the fixing belt 83 is cooled down when it reaches the contact start position [A], the fixing belt 83 is given a larger heating value from the heating roller 81, by the first heater lamp 84 arranged adjacent to the internal circumferencial direction in the heating roller 81, thereby the fixing belt 83 is heated up rapidly to high temperatures.

Figure 5:
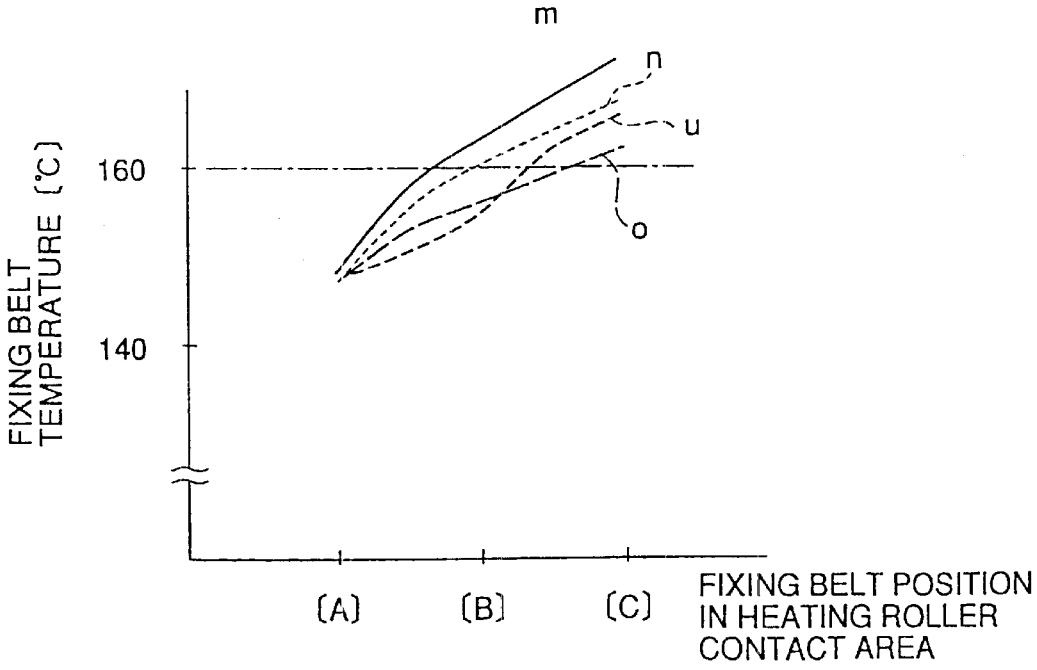
FIG. 5 is a graph showing temperatures of a fixing device at positions [A], [B], and [C] around a heating roller of the fixing device according to a preferred embodiment of the present invention shown in FIG. 3.

For instance, in fixation operation, when the transfer speed of the fixing belt 83 is 100 mm/s, the temperatures appear as the solid line m in FIG. 5, and when the transfer speed of the fixing belt 83 is higher at 170 mm/s, the temperatures appear as the dot line n in FIG. 5, while when the transfer speed of the fixing belt 83 is further higher at 240 mm/s, the temperatures appear as the broken line o in FIG. 5. In every case of these transfer speeds, the temperature of fixing belt 83 is increased rapidly as soon as it reaches the contact start position [A] where it starts contacting the heating roller 81 and heating is carried out.

And after the fixing belt 83 passes the position where the first heater lamp 84 is arranged adjacent to the fixing belt, the temperature of the fixing belt 83 is increased as linearly as conventional devices, while it reaches the separation position [C]. And further, since the first heater lamp 84 is arranged at the upstream side of the transfer direction of the fixing belt 83 from the central position of the contact area between the fixing belt 83 and the heating roller 81, after the temperature thereof is increased rapidly, the fixing belt 83 has a long distance where it is further heated up by the heating roller 81, thereby, a sufficient temperature increase is attained for fixation.

As a result, with the rapid temperature increase of the fixing belt 83 as soon as it contacts the heating roller 81, and with the securement of the contact distance with the heating roller 81 after that, while the fixing belt goes around the heating roller 81 one rotation, the temperature increase level to increase the temperature of the fixing belt 83 is entirely increased in comparison with the prior art. As a consequence, for example, if the fixing belt 83 is conveyed at high transfer speed from 100 mm/s to 240 mm/s, while the fixing belt 83 goes from the contact start position [A] and reached the separation position [C], the fixing belt is heated up to over 160° C., and fixation available temperatures are attained.

By the way, in the case, for instance, where the first heater lamp 84 is arranged at the downstream side of the transfer direction of the fixing belt 83 from the central position [B] of the contact area of the fixing belt 83 and the heating roller 81, the transfer speed of the fixing belt is for example 170 mm/s, as shown in dot line u in FIG. 5, the rapid temperature increase of the fixing belt 83 appears after it passes the central position [B], and the contact distance with the heating roller 81 after that cannot be attained sufficiently, the temperature of the fixing belt 83 at the moment when it reaches the separation position [C] is reduced in comparison with the case where the first heater lamp 84 is arranged at the upstream side of the transfer direction of the fixing belt 83 from the central position [B].

While, with reference to the temperature increase characteristics of the fixing belt 83, heretofore described are the temperature increase characteristics in fixation operation wherein the fixing belt 83 is cooled down at around 145° C. through 150° C. at the moment when it reaches at the contact start position [A], the temperature increase characteristics of the fixing belt 83 in this preferred embodiment may attain the same temperature increase characteristics also at warming up operation after power is turned on, and from the following fixation standby status, and to the first copy start moment when fixation is available.

More concretely, at the moment of warming up, the temperature of the fixing belt 83 at the moment when power is turned on and the fixing belt reaches the contact start position [A] is cooled down to room temperatures, and after then, while it goes around the heating roller 81 and the support roller 82 several times, the temperature of the fixing belt 83 is gradually increased, and the temperature increase characteristics of the fixing belt 83 by contact with the heating roller 81 at this moment become the same as those shown in FIG. 5. Namely, as soon as the fixing belt 83 reaches at the contact start position [A] which it starts contacting the heating roller 81, it is heated up, and the temperature thereof is increased rapidly, and after that, while the fixing belt 83 contacts the heating roller 81 until it reaches the separation position [C], and the temperature thereof is increased sufficiently, accordingly the temperature increase level at the moment when the fixing belt goes around the heating roller 81 one rotation is high in comparison with the prior art, and the warming up time until fixation standby status at around 160° C. is attained is shortened in comparison with conventional fixing devices.

Temperature increase characteristics at first copy status are the same as those at warming up status mentioned above, concretely, the temperature of the fixing belt 83 at the moment when it reaches the contact start position [A] is kept at about 160° C. of standby status, and after that, while the fixing belt 83 goes around the heating roller 81 and the support roller 82 several times, the temperature of the fixing belt 83 is increased gradually, and the temperature increase characteristics at this moment become the same as those shown in FIG. 5. Namely, as soon as the fixing belt 83 reaches the contact start position [A] at which heating is restarted, the temperature thereof is increased rapidly, and after that, while the fixing belt 83 contacts the heating roller 81 until it reaches the separation position [C], and the temperature thereof is increased sufficiently, accordingly the temperature increase level at the moment when the fixing belt goes around the heating roller 81 one rotation is high in comparison with the prior art, and the first copy time until fixation standby status at around 160° C. is attained is shortened in comparison with conventional fixing devices.

Further, so far as the transfer speed of the fixing belt 83 is low, even with the conventional heating roller 2 wherein a heater 1 is arranged at the rotational center, it is possible to keep long contact time for the heating roller 2 and the fixing belt 4, and the fixing belt 4 attains a temperature increase enough to carry out a preferable fixation operation, consequently, the heating roller 81 of this preferred embodiment can heat up the fixing belt 83 more effectively than conventional ones according to the prior art, in the case where the transfer speed of the fixing belt 83 is set at higher speeds than 100 mm/s.

Now actions are described hereinafter. At the moment when the start of a full color image formation is designated via an operation panel not illustrated herein, image forming conditions including the number of images formed, image magnifications, and so forth are set, and a copy key (not illustrated herein) is turned on, then an image signal per color is sent to the image forming portion 10, while the respective recording devices 12Y, 12M, 12C and 12BK for yellow (Y), magenta (M), cyan (C) and black (BK) work at a specified timing, and toner images for respective colors as developing agent images are formed on the respective photosensitive drums 14Y, 14M, 14C and 14BK.

In more details, with the recording device 12Y for yellow (Y) as an example, the photosensitive drum 14Y turns in the arrow u direction and carries out image forming processes one after another, first the photosensitive drum is electrostatically charged uniformly by the electrostatic charger 16Y. Secondly, exposure actions are carried out onto this uniformly charged photosensitive drum 14Y by the exposure device 17Y, thereby a latent image corresponding to an image signal of yellow (Y) is formed on the photosensitive drum 14Y. After then, the developing device 18Y develops the photosensitive drum 14Y, and thereby a toner image of yellow (Y) is formed on the photosensitive drum 14Y.

In the same manner as mentioned above, the respective recording devices 12M, 12C and 12BK for magenta (M), cyan (C) and black (BK), toner images of respective colors are formed on the photosensitive drums 14M, 14C and 14BK respectively.

On the other hand, in synchronization with the forming operation of respective color toner images onto the photosensitive drums 14Y, 14M, 14C and 14BK, the pickup roller 26 or the hand insertion paper sheet feed roller 23 is activated, and a paper sheet P is fed from the paper sheet feed cassette device 24 or manually, and the front end of this paper sheet P is position arranged by the resist roller 28, and the paper sheet is sent to the transfer conveyor belt 13.

The paper sheet P sent to the transfer conveyor belt 13 is given electric charge by the absorption roller 43, and electrostatically absorbed to the transfer conveyor belt 13, and conveyed in the arrow v direction as the transfer conveyor belt 13 runs. The paper sheet P is first sent to a yellow toner image transfer position, that is, the position where the photosensitive drum 14Y and the transfer roller 20Y face to each other via the transfer conveyor belt 13. At this yellow toner image transfer position, the paper sheet P touches the yellow toner image that is formed on the photosensitive drum 14Y. And in this status, the yellow toner image on the photosensitive drum 14Y is transferred onto the paper sheet p by action of the transfer roller 20Y.

The transfer roller 20Y, having semiconductor properties, supplies an electric field of opposite polarity to the electric potential of the yellow toner image that is electrostatically attached onto the photosensitive drum 14Y from the rear side of the transfer conveyor belt 13. This electric field works onto the yellow toner image on the photosensitive drum 14Y via the transfer conveyor belt 13 and the paper sheet P. Thereby, the yellow toner image is transferred from the photosensitive drum 14Y to the paper sheet P.

The paper sheet P, onto which a yellow toner image has been transferred in the manner mentioned above, is conveyed then to the toner image transfer position of each of the respective recording devices, i.e., the magenta recording device 12M, the cyan recording device 3C, and the black recording device 12BK in this order. Through this conveyance, in the same manner explained above, a magenta toner image, a cyan toner image, and a black toner image are transferred onto the paper sheet P sequentially in multiple layers, thereby a full color toner image is formed on the paper sheet P.

The paper sheet, on which a full color toner image has been formed, is then peeled off 15 the transfer conveyor belt 13 and sent to the fixing device 8, where the full color toner image of multiple color layers is permanently fixed according to the actions described later herein.

Further after fixation, the paper sheet P is discharged via the paper discharge roller coupling 31 onto the paper discharge sheet tray 32. On the other hand, after peeling of the paper sheet P, the transfer conveyor belt 13 is continuously driven rotating, and is cleaned of attached toner and paper powder by the belt cleaner 46. After completion of this cleaning, the surface of the transfer conveyor belt 13 is electrostatically discharged by the transfer conveyor belt discharge roller 44 so that the electric potential thereon should be uniform.

And, the respective photosensitive drums 14Y, 14M, 14C, and 14BK after transfer of toner images are continuously driven rotating, and remaining toners and paper powder are cleaned off by the cleaning devices 21Y, 21M, 21C and 21BK. After completion of this cleaning, the surface of each of the photosensitive drums 14Y, 14M, 14C and 14BK is electrostatically discharged by the electrostatic dischargers 22Y, 22M, 22C and 22BK, and waits for next full color image forming process.

In the next place, actions of the fixing device 8 are described hereinafter. When the power source of the image forming portion 10 is turned on, warming up operation starts, and so as to heat the fixing belt 83 and the pressure roller 87 up to fixation operation standby status, the first heater lamp 84 and the second heater lamp 86 are turned on. At the same time, the fixing belt 83 is rotated in the arrow s direction at, for example, 170° mm/s, and following this, the pressure roller 87 is rotated in the arrow t direction.

In this warming up operation, the fixing belt 83 is heated by the heating roller 81 that is arranged at the upstream side from the central position [B] and can give larger heating value, by the first heater lamp 84, and thereby the temperature thereof is increased as shown in the temperature increase characteristics in FIG. 5. And when the temperature of the fixing belt 83 reaches at 160° C., the image forming portion 10 enters a standby status. After standby status is reached, the rotation speed of the fixing belt 83 is reduced by a control device not illustrated herein, and further, the first heater lamp 84 and the second heater lamp 86 are controlled ON/OFF, thereby the temperature of the fixing belt 83 is maintained at around 160° C.

After the above, in the above standby status, when the copy key (not illustrated herein) is turned on and copy operation is started, in the fixing device 8, so as to heat the fixing belt 83 and the pressure roller 87 up to over 160° C. for first copy, the first heater lamp 84 and the second heater lamp 86 are turned on, and at the same time, the fixing belt 83 and the pressure roller 87 that follows the fixing belt are rotated at 170 mm/s. For the period from this standby status through first copy available status, the temperature of the fixing belt 83 is increased in accordance with the temperature increase characteristics shown in FIG. 5.

When the temperature of the fixing belt 83 reaches over 160° C., the paper sheet P onto which a full color toner image has been transferred through the above-mentioned full color image forming process is made to go through the nip portion between the fixing belt 83 and the pressure roller 87 in the fixing device 8, thereby the full color toner image on the paper sheet P is heat press fixed.

And during fixation operation, the first heater lamp 84 and the second heater lamp 86 are controlled ON/OFF so that the temperature of the fixing belt 83 is maintained at fixation available status at over 160° C.

After completion of a fixation operation, the rotating speed of the fixing belt 83 is reduced once again, and further the first heater lamp 84 and the second heater lamp 86 are controlled ON/OFF, and the temperature of the fixing belt 83 is maintained at about 160° C., and the fixing device 8 is made into its standby status.

In the manners mentioned heretofore, so as to heat up the fixing belt 83, the first heater lamp 84 arranged in the heating roller 81 is positioned at the place displaced in the radius direction from the rotational center [D] of the heating roller 81, at the upstream side of the transfer direction of the fixing belt 83 from the central position [B] of the contact area of the fixing belt 83 and the heating roller 81, thereby even when the transfer speed of the fixing belt 83 is as high as 240 mm/s, it is possible to heat up the fixing belt at preferable temperature increase characteristics while the fixing belt goes from the contact start position [A] with the heating roller 81 to the separation position [C], without increasing the electricity consumption of the first heater lamp 84 or making the diameter of the heating roller 81 larger, and accordingly the fixing belt 83 can obtain larger heating value from the heating roller 81 than in conventional ones according to the prior art.

As a consequence, without making the diameter of the heating roller 81 larger, or increasing electricity consumption of the first heater lamp 84, the temperature of the fixing belt 83 is increased up to fixation available temperatures while it contacts the heating roller 81, and an improved fixing property is obtained in the high speed fixing belt 83. Furthermore, since the temperature increase level of the fixing belt 83 by the heating roller 81 is increased in comparison with the conventional one, according to the present invention, it is possible to shorten the warm up time and the first copy time, and to realize a far higher speed processing in comparison with the prior art, and it is also possible to reduce electricity consumption at the warm up time and the first copy time.

By the way, the invention may be embodied in other specific forms without departing from the spirit or essential characteristics thereof, therefore for example, the raw materials and structures and so forth of the heating roller and the fixing belt are not limited, while the raw material for the heating roller is not limited to aluminum (Al) so far as raw material can efficiently transmit the heat from the heater to the fixing belt, and as for the fixing belt, any raw material may be used so far as it can preferably hold a heating value given from the heating roller 81 to the fixation position, and have flexibility enough to keep a sufficient nip width with the pressure roller.

And the transfer speed of the fixing belt is not limited, however, it is preferred that the transfer speed thereof should be over 100 mm/s, because the advantages of the present invention appear remarkably in high-speed transfer.

Further, the fixation available temperatures of the fixing belt, the setting temperatures at standby status, and so forth are optional.

As mentioned heretofore, according to the present invention, a heater to be arranged inside of a heating roller is arranged displaced toward the radius direction of the side where it contacts a fixing belt, from the rotational center of heating roller, and the fixing belt is heated up rapidly at a position adjacent to the heater, and further heated up by contact with the heating roller, thereby it is possible to preferably heat up the fixing belt, in spite of shortened contact time with the heating roller owing to the high speed of the fixing belt.

Furthermore, a heater in a heating roller is arranged displaced toward the radius direction of the heating roller at the upstream direction of the transfer direction of a fixing belt, from the central position of the area wherein the fixing belt touches the heating roller, the fixing belt can hold a long contact distance with the heating roller, for rapid temperature increase at a position adjacent to the heater, as a consequence, it is possible to obtain a far more preferable heating in spite of high speed of transfer velocity. Moreover, an image forming device, onto which a fixing device according to the present invention is loaded, is not restricted to the structure shown in FIG. 2.

As a consequence, according to the present invention, it is possible for a fixing belt to attain a sufficient heating by contact with a heating roller, without making heater electricity consumption larger, or making a heating roller diameter larger, irrespective of high speed of the transfer speed of fixing belt, thereby it is possible to obtain improved image quality by preferred fixation, without deteriorating energy saving and small size and light weight of a fixing device. Still further, sufficient heating by the heating roller enables shortening of the warm up time and the first copy time of the fixing belt, and to attain further high speed fixing operation accordingly, and also to reduce electricity consumption as a whole further.

What is claimed is:

1. A fixing device comprising:

first heating means that is of an endless belt shape for heating a record medium having a developed image;

pressurizing means that is of a roller shape for pinching and conveying the record medium together with the first heating means to fix the developed image;

second heating means that is of a roller shape and contacts the first heating means for heating the first heating means at a specified temperature; and third heating means that is arranged in the second heating means and is displaced from the rotational center of the second heating means to the first heating means side for heating the second heating means, the third heating means being positioned displaced toward the radius direction from the rotational center of the second heating means, at the upstream side of the transfer direction of the first heating means from the central position of the contact area of the first heating means and the second heating means.

2. A fixing device set forth in claim 1, wherein if the inside radius of the second heating means is designated as r, the third heating means is positioned in the distance range from 0.3 r through 0.8 r from the inside wall of the second heating means.

3. A fixing device set forth in claim 1, further comprising supporting means that is of a roller shape for supporting the first heating means at the position where the record medium is pinched and conveyed by the first heating means and the pressuring means, and wherein the first heating means is arranged between the second heating means and the supporting means.

4. A fixing device set forth in claim 1, wherein the second heating means has a high heat transmission ratio.

5. A fixing device set forth in claim 1, wherein the third heating means controls the first heating means by turning ON/OFF the first heating means so as to heat the first heating means up to the specified temperature.

6. A fixing device set forth in claim 1, wherein the transfer speed of the first heating means is over 100 mm/sec.

7. A fixing device comprising:

a fixing belt to heat a record medium having a developed image;

a pressure roller to pinch and convey the record medium together with the fixing belt to fix the developed image;

a heating roller contacting the fixing belt to heat the fixing belt at a specified temperature; and a heater arranged in the heating roller and displaced from the rotational center of the heating roller to the fixing belt side to heat the heating roller, the heater being positioned displaced toward the radius direction from the rotational center of the heating roller, at the upstream side of the transfer direction of the fixing belt from the central position of the contact area of the fixing belt and the heating roller.

8. A fixing device set forth in claim 7, wherein if the inside radius of the heating roller is designated as r, the heater is positioned in the distance range from 0.3 r through 0.8 r from the inside wall of the heating roller.

9. A fixing device set forth in claim 7, further comprising a support roller to support the fixing belt at the position where the record medium is pinched and conveyed by the fixing belt and the pressure roller, and wherein the fixing belt is arranged between the heating roller and the support roller.

10. A fixing device set forth in claim 7, wherein the heating roller has a high heat transmission ratio.

11. A fixing device set forth in claim 7, wherein the heater controls the fixing belt by turning ON/OFF the fixing belt so as to heat the fixing belt up to the specified temperature.

12. A fixing device set forth in claim 7, wherein the transfer speed of the fixing belt is over 100 mm/sec.

13. A fixing method wherein a record medium having a developed image is pinched and conveyed by a fixing belt which is heated by contact with a heating roller and a pressure roller, and thereby the developed image is heat pressure fixed, comprising the steps of:

heating the heating roller by a heater that is arranged in the heating roller and is displaced from the rotational center of the heating roller to the radius direction of the fixing belt side, and further displaced from the central position of contact area of the heating roller to the upstream side in the conveyance direction of the fixing belt;

making the heating roller contact the fixing belt thereby heating up the fixing belt; and inserting the record medium into a nip portion that is formed between the fixing belt after going away from the heating roller, and a pressure roller that pressure contacts the fixing belt.

* * * * *